US007631582B2

(12) United States Patent
Hu

(10) Patent No.: US 7,631,582 B2
(45) **Date of Patent: *Dec. 15, 2009**

(54) WRENCH WITH ANTI-SLIPPING FUNCTION

(76) Inventor: Bobby Hu, 16F, No. 367, Section 1, Gong Yi Road, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/970,685

(22) Filed: Jan. 8, 2008

(65) Prior Publication Data

US 2008/0098860 A1 May 1, 2008

Related U.S. Application Data

(63) Continuation-in-part of application No. 11/383,047, filed on May 12, 2006, now Pat. No. 7,380,483.

(30) Foreign Application Priority Data

Dec. 27, 2005 (TW) ..... 94146788 A

(51) Int. Cl.
*B25B 23/16* (2006.01)

(52) U.S. Cl. ..... 81/177.1; 81/176.1

(58) Field of Classification Search ..... 81/177.1, 81/125.1, 176.1, 119, 488, 489, 121.1, 124.3
See application file for complete search history.

(56) References Cited

U.S. PATENT DOCUMENTS

| | | | | |
|---|---|---|---|---|
| 4,969,231 | A * | 11/1990 | Mader et al. | 16/421 |
| 5,797,300 | A | 8/1998 | Fairbanks | 81/60 |
| 6,647,834 | B2 | 11/2003 | Hu | 81/119 |
| 7,380,483 | B2 * | 6/2008 | Hu | 81/176.1 |
| 2002/0062719 | A1 | 5/2002 | Friedman et al. | 81/125.1 |
| 2002/0092384 | A1 | 7/2002 | Shih-Kuei | 81/125.1 |
| 2007/0261520 | A1 * | 11/2007 | Chang et al. | 81/177.1 |

OTHER PUBLICATIONS

TW Utility Model Patent Publication No. M 240308, Aug. 11, 2004. 6 pages.

* cited by examiner

*Primary Examiner*—David B Thomas
(74) *Attorney, Agent, or Firm*—Alan Kamrath; Kamrath & Associates PA

(57) ABSTRACT

A wrench includes a body having two ends and a handle between the ends of the body. At least one of the ends of the body can be used for driving an object. The handle includes an upper face and a lower face opposite to the upper face. An anti-slipping section is formed on each of two end portions of the upper face and the lower face of the handle. Each anti-slipping section includes a plurality of embossed patterns. Since each anti-slipping section extends across the end portions of the handle, the user's hand will not slip during operation of the wrench even though there is oil on the user's hand.

24 Claims, 20 Drawing Sheets

WRENCH WITH ANTI-SLIPPING FUNCTION

CROSS REFERENCE

The present application is a continuation-in-part application of U.S. patent application Ser. No. 11/383,047, filed on May 12, 2006, now U.S. Pat. No. 7,380,483, of which the entire disclosure is incorporated herein.

BACKGROUND OF THE INVENTION

1. Field of the Invention

The present invention relates to a wrench with an anti-slipping function.

2. Description of the Related Art

Taiwan Utility Model No. M240308 discloses a ratchet wrench having an anti-slip protective jacket. The ratchet wrench comprises a body having a handle on which the anti-slip protective jacket is integrally formed by injection molding. The protective jacket includes a regular anti-slipping section consisting of a plurality of regular protrusions and recessions for anti-slipping purposes. However, the end portions of the handle adjacent to two ends of the body are not provided with the anti-slipping protrusions and recessions.

In the beginning of tightening of a fastener that requires smaller torque, an end of the body is coupled with the fastener and a user can rapidly turn the fastener by grasping an end portion of the handle with the thumb and the index finger of one hand and moving the wrench back and forth. In the final stage of tightening that requires larger torque, the user can hold the other end portion of the handle distal to the fastener to provide larger torque. However, since the end portions of the handle are not provided with the anti-slipping structure, the user's hand is liable to slip and might be injured when impinging an object.

Further, the regular protrusions and recessions formed in the intermediate portion of the handle extend in a direction transverse to the extending direction of the handle such that the regular anti-slipping section merely provides an anti-slipping effect when a longitudinal force is applied. More specifically, the anti-slipping effect is limited, as the user's hand moves in a direction transverse to the extending direction of the handle while operating the handle.

Even if the jacket extends to the end portions of the handle, the jacket made of rubber or plastic is liable to be scraped and damaged when impinged upon a metal tool. The anti-slipping effect degrades accordingly. Further, the jacket deteriorates when coming in contact with oil, leading to damage to the jacket and loss of the anti-slipping function.

In another embodiment disclosed in Taiwan Utility Model No. M240308, the wrench body includes upper and lower grooves for coupling with protrusions of the jacket. In a further embodiment disclosed in Taiwan Utility Model No. M240308, the wrench body includes through-holes, and an upper jacket has projections extending through the through-holes for snapping engagement with engaging holes in a lower jacket. In still another embodiment disclosed in Taiwan Utility Model No. M240308, the wrench body includes screw holes, and screws are extended through holes in upper and lower jackets and into the screw holes of the wrench body. These designs result in an increase in the manufacturing cost while failing to provide the required anti-slipping effect.

SUMMARY OF THE INVENTION

A wrench in accordance with the present invention comprises a body including two ends and a handle between the ends of the body. At least one of the ends of the body is adapted for driving an object. The handle includes an upper face and a lower face opposite to the upper face. An anti-slipping section is formed on each of two end portions of the upper face and the lower face of the handle. Each anti-slipping section includes a plurality of embossed patterns.

Since each anti-slipping section extends across the end portions of the handle, the user's hand will not slip during operation of the wrench even though there is oil on the user's hand.

In an example, the embossed patterns have regular shapes and are irregularly distributed.

In another example, the embossed patterns have irregular shapes and are regularly distributed.

In a further example, the embossed patterns have irregular shapes and are irregularly distributed.

Preferably, each anti-slipping section has a length substantially equal to one fourth of an overall length of the handle.

Preferably, the handle further comprises two lateral faces between the upper face and the lower face of the handle. Each lateral face has a width smaller than that of the upper and lower faces.

In an example, each anti-slipping section is spaced from a joint area between each lateral face and one of the upper face and the lower face.

In another example, each anti-slipping section extends to the joint area between each lateral face and one of the upper face and the lower face.

The upper face and the lower face may be arcuate.

In an example, the upper and lower faces are outwardly arcuate.

In another example, the upper and lower faces are inwardly arcuate.

The anti-slipping sections on each of the upper face and the lower face of the handle may further extend across an intermediate section of the handle between the end portions of the handle.

Preferably, the length of each anti-slipping section is not smaller than an average length of the distal section of a thumb of a user and not greater than two times the average length of the distal section of the thumb of the user.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
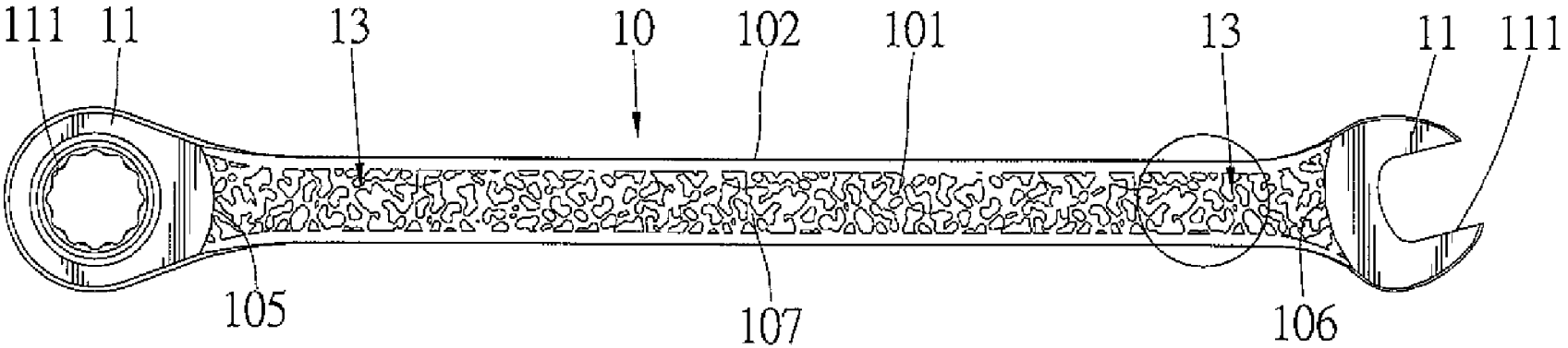
FIG. 1 is a top view of a first embodiment of a wrench in accordance with the present invention.
Figure 2:
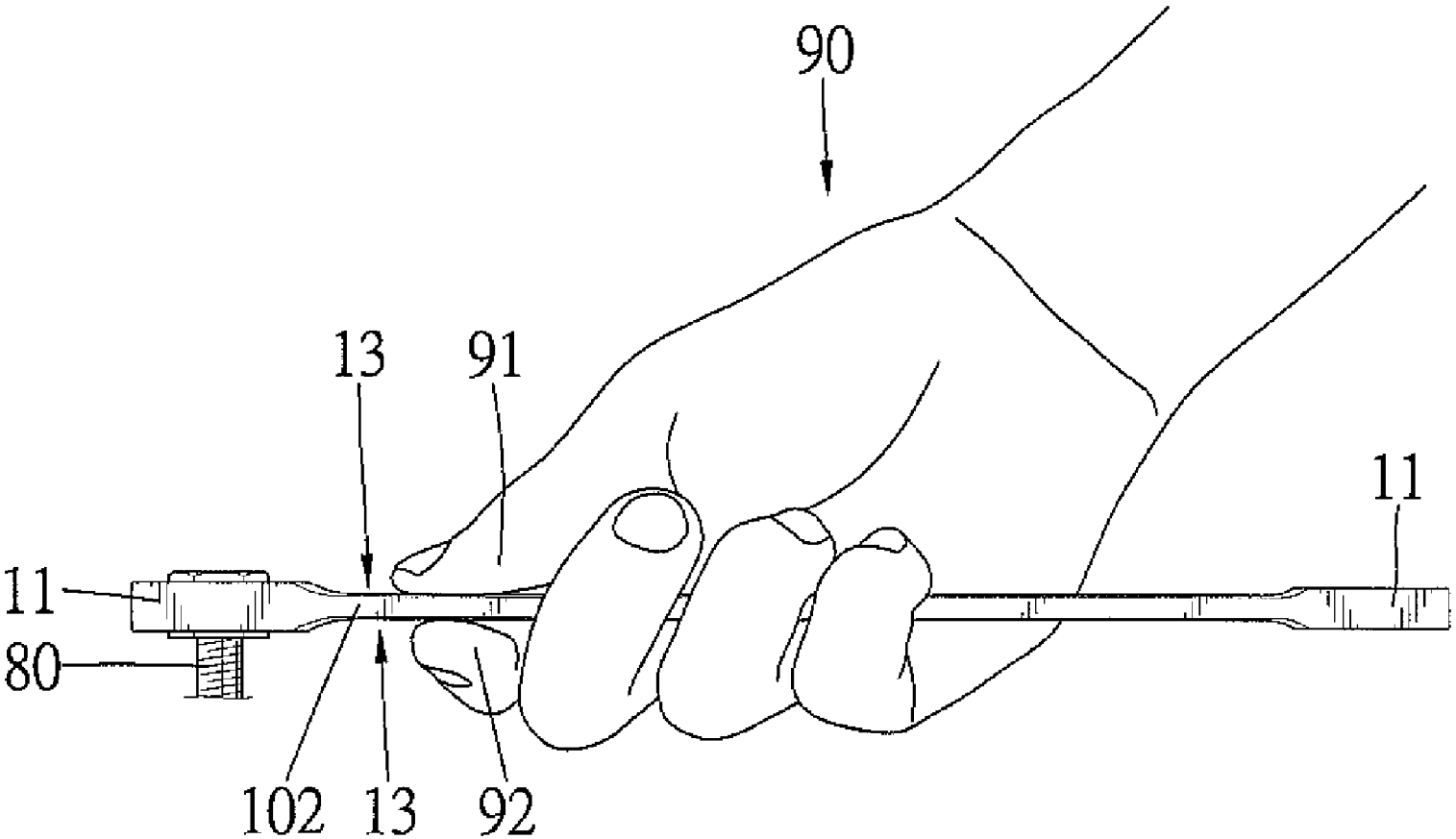
FIG. 2 is a schematic side view illustrating use of the wrench for rapid fastening of a fastener.
Figure 3:
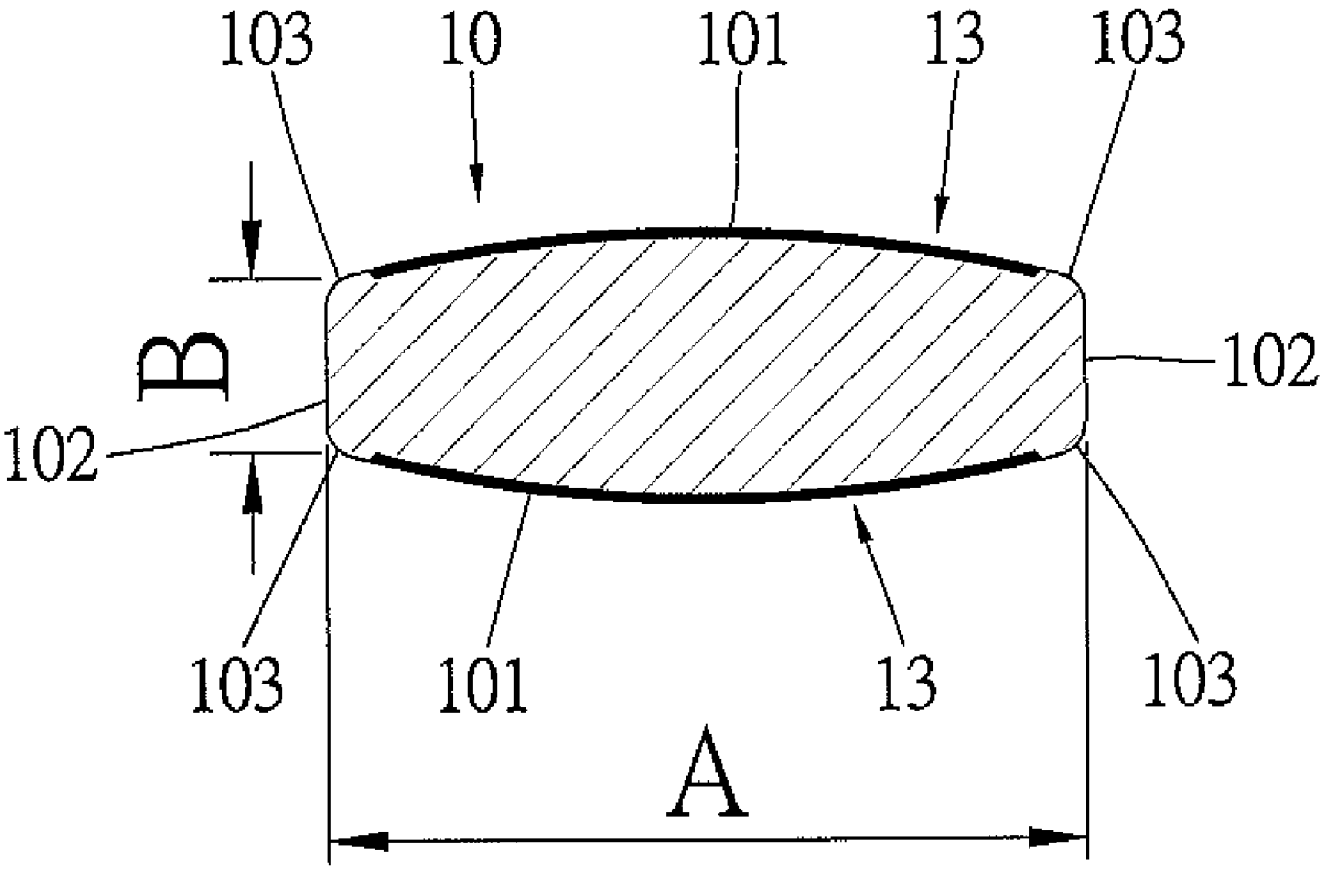
FIG. 3 is a sectional view of a handle of the wrench in FIG. 1.

Referring to FIGS. 1 through 3, a first embodiment of a wrench in accordance with the present invention comprises a body (not labeled) having two ends 11 and a handle 10 with a first and a second end portion 105, 106 which connects to the respective end 11 and an intermediate section 107 between the first and second end portions 105, 106. Each end 11 of the body includes a driving section or driving member 111 for driving a fastener, a socket, an adaptor, etc.

Figure 4:
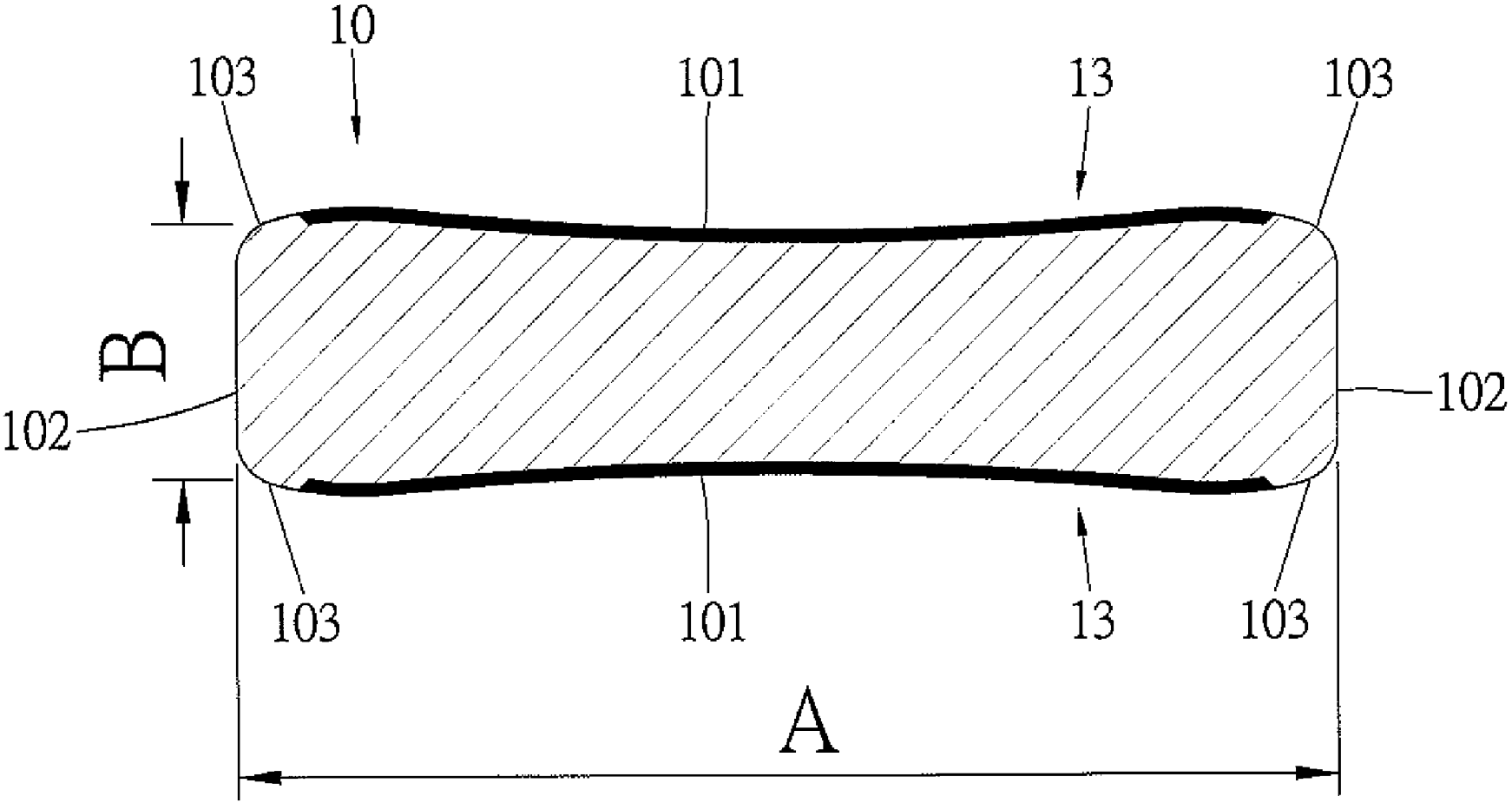
FIG. 4 is a section view of an alternate handle of the wrench in FIG. 1.

The handle 10 includes two opposite holding faces 101 and two opposite lateral faces 102 respectively between the holding faces 101. Referring to FIG. 3, each holding face 101 has a width A, and each lateral face 102 has a width B smaller than the width A. In this example, the holding faces 101 respectively correspond to upper and lower horizontal faces of the ends 11 of the body, whereas the lateral faces 102 correspond to an outer circumferential face of the ends 11 of the body. Each holding face 101 may be outwardly arcuate, and each lateral face 102 may be planar. However, as best seen in FIG. 4, the handle 10 may of an alternate configuration in which each holding face 101 is inwardly arcuate and in which each lateral face 102 is planar.

Figure 1A:
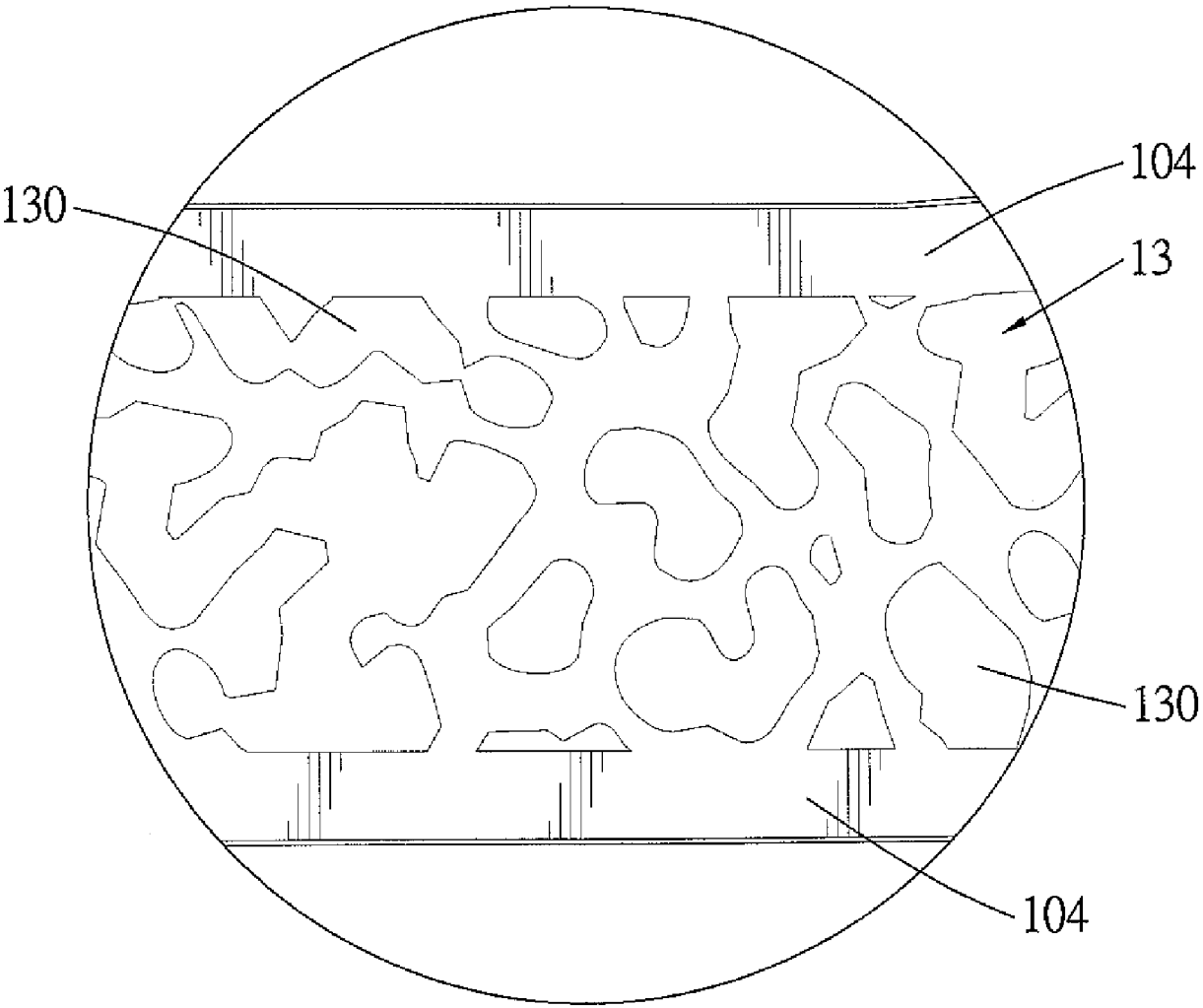
FIG. 1A is an enlarged view of a circled portion in FIG. 1.

An anti-slipping section 13 is provided on each holding face 101 to provide the handle 10 with friction in all directions. The anti-slipping section 13 extends through an overall length of the handle 10 but does not include the ends 11. Each anti-slipping section 13 includes a plurality of embossed patterns 130. The embossed patterns 130 in this embodiment have irregular shapes and are irregularly distributed. Two lateral sides of each anti-slipping section 13 are spaced from the jointing areas 103 between the respective holding faces 101 and the respective lateral faces 102 (see the blank area 104 in FIG. 1A). Each anti-slipping section 13 is directly formed on the handle 10 and has a certain depth without affecting the strength of the handle 10. Thus, the handle will not be damaged when scraped or impinged by an object while providing an excellent anti-slipping effect and enjoys the benefit of reduced finishing costs. The problems of the jacket in Taiwan Utility Model No. M240308 are overcome.

Figure 5:
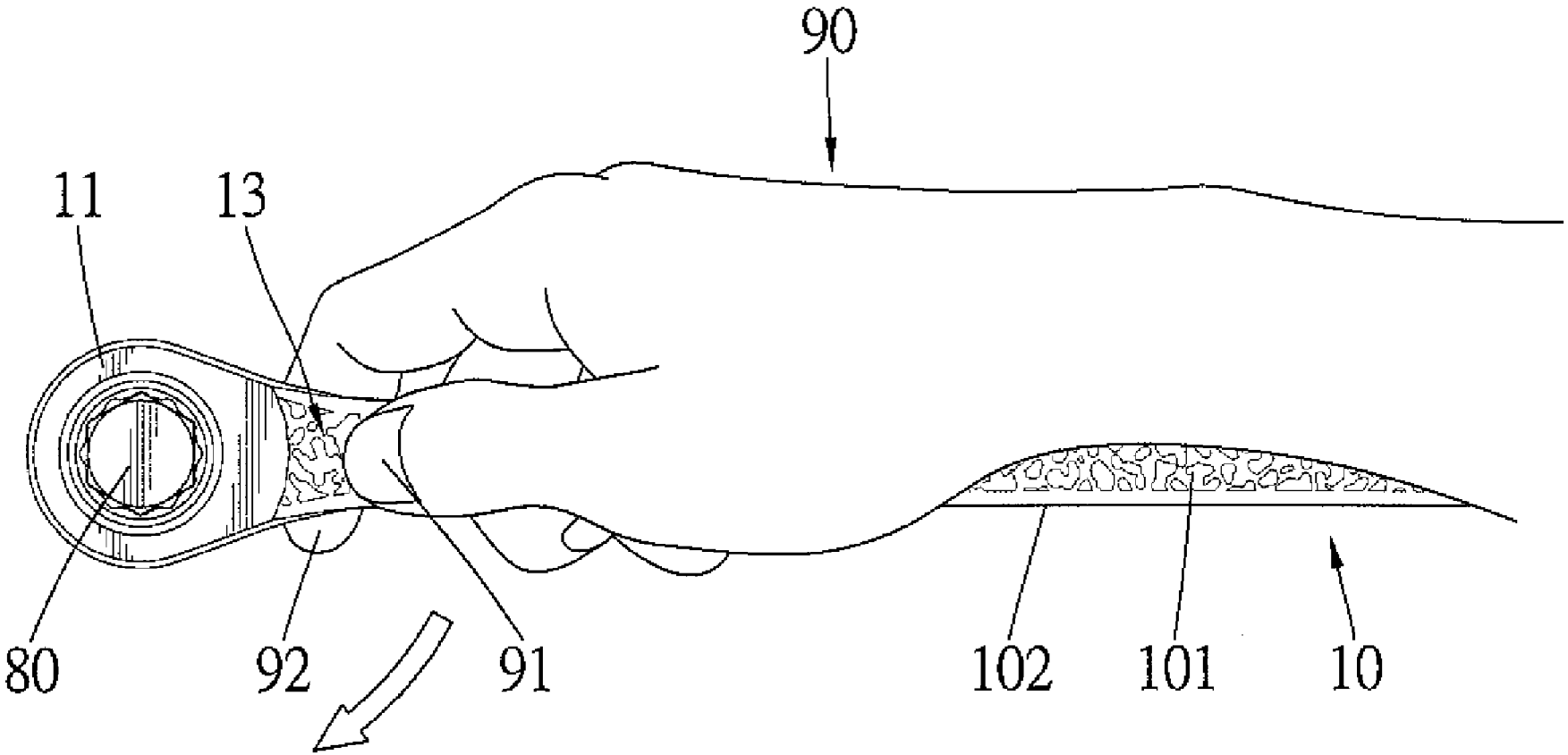
FIG. 5 is a top view illustrating use of the wrench for rapid fastening of a fastener.

Referring to FIGS. 2 and 5, in the beginning of tightening of a fastener 80, smaller torque is required for turning the fastener 80. An end 11 of the wrench is coupled with the fastener 80, and a user may rapidly turn the fastener 80 by grasping an end portion of the handle 10 with the distal section of the thumb 91 and the distal section of the index finger 92 of one hand 90 and moving the wrench back and forth. This end 11 has a drive member 111 allowing ratcheting operation, which is conventional. Since each anti-slipping section 13 extends across the end portions of the handle 10, the user's hand 90 will not slip during operation of the wrench even though there is oil on the user's hand 90.

Figure 6:
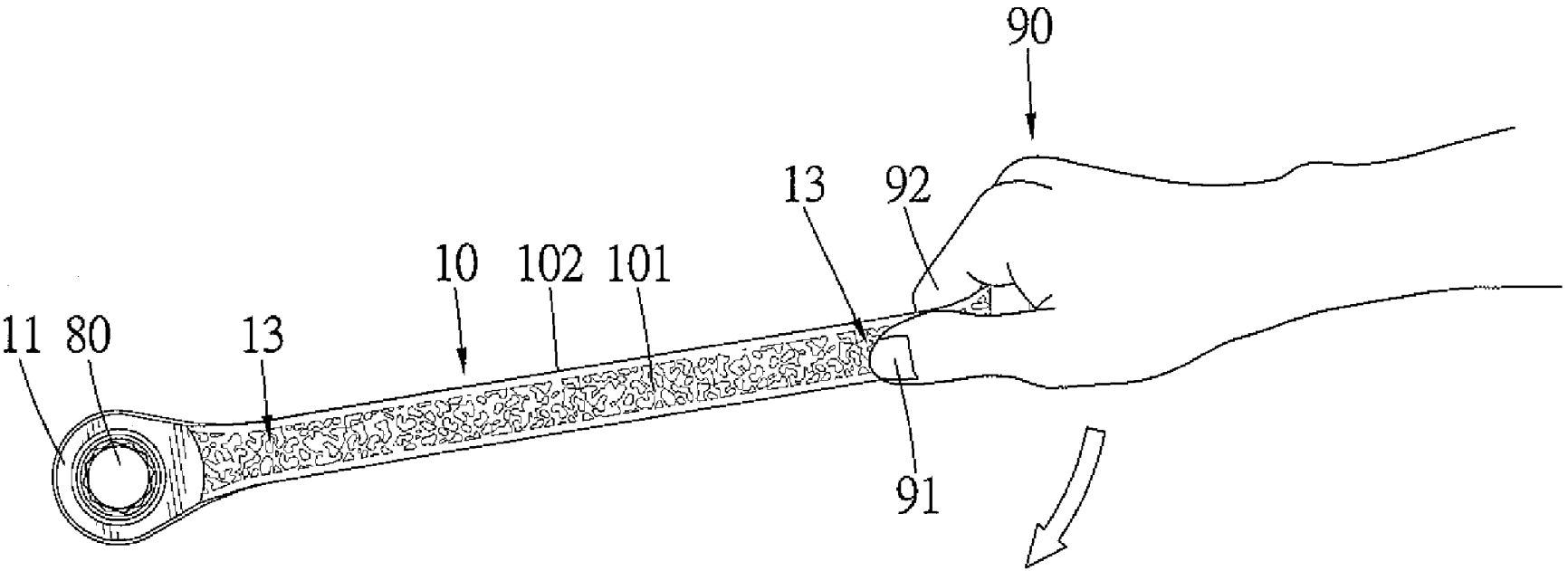
FIG. 6 is a top view illustrating final tightening of a fastener with the wrench in accordance with the present invention.

Referring to FIG. 6, in the final stage of tightening, larger torque is required. The user holds the other end portion of the handle 10 distal to the fastener 80 to provide larger torque. Since each anti-slipping section 13 extends across the ends portions of the handle 10, the user's hand 90 will not slip during operation of the wrench even though there is oil on the user's hand 90.

Since the anti-slipping section 13 provides friction in all directions for the distal sections of the thumb 91 and the index finger 92 of the user, the holding stability is enhanced during operation of the wrench. Slippage will not occur even though there is oil on the user's hand 90.

Figure 7:
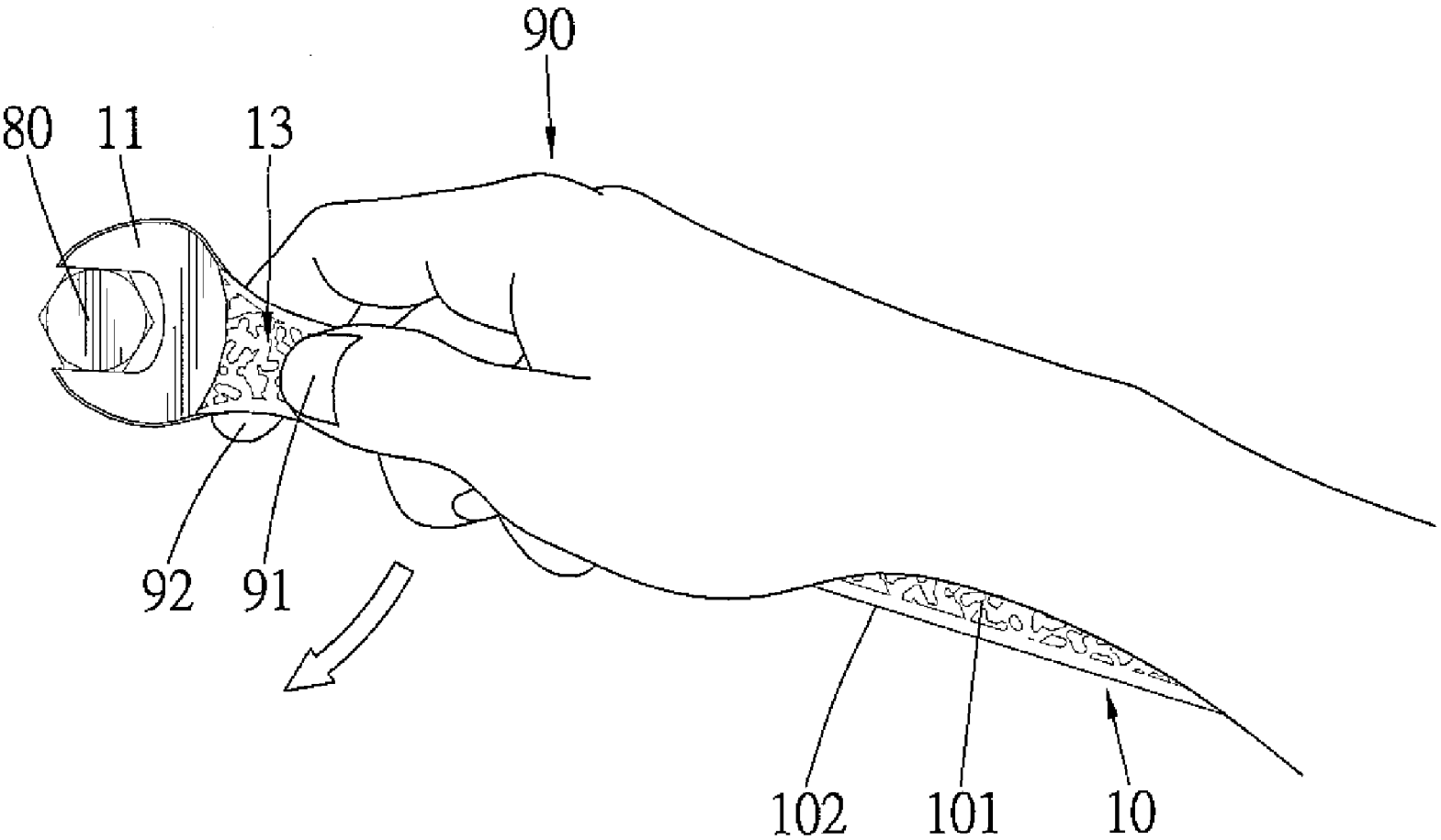
FIG. 7 is a view similar to FIG. 5, illustrating use of the other end of the wrench in accordance with the present invention for rapid fastening of a fastener.
Figure 8:
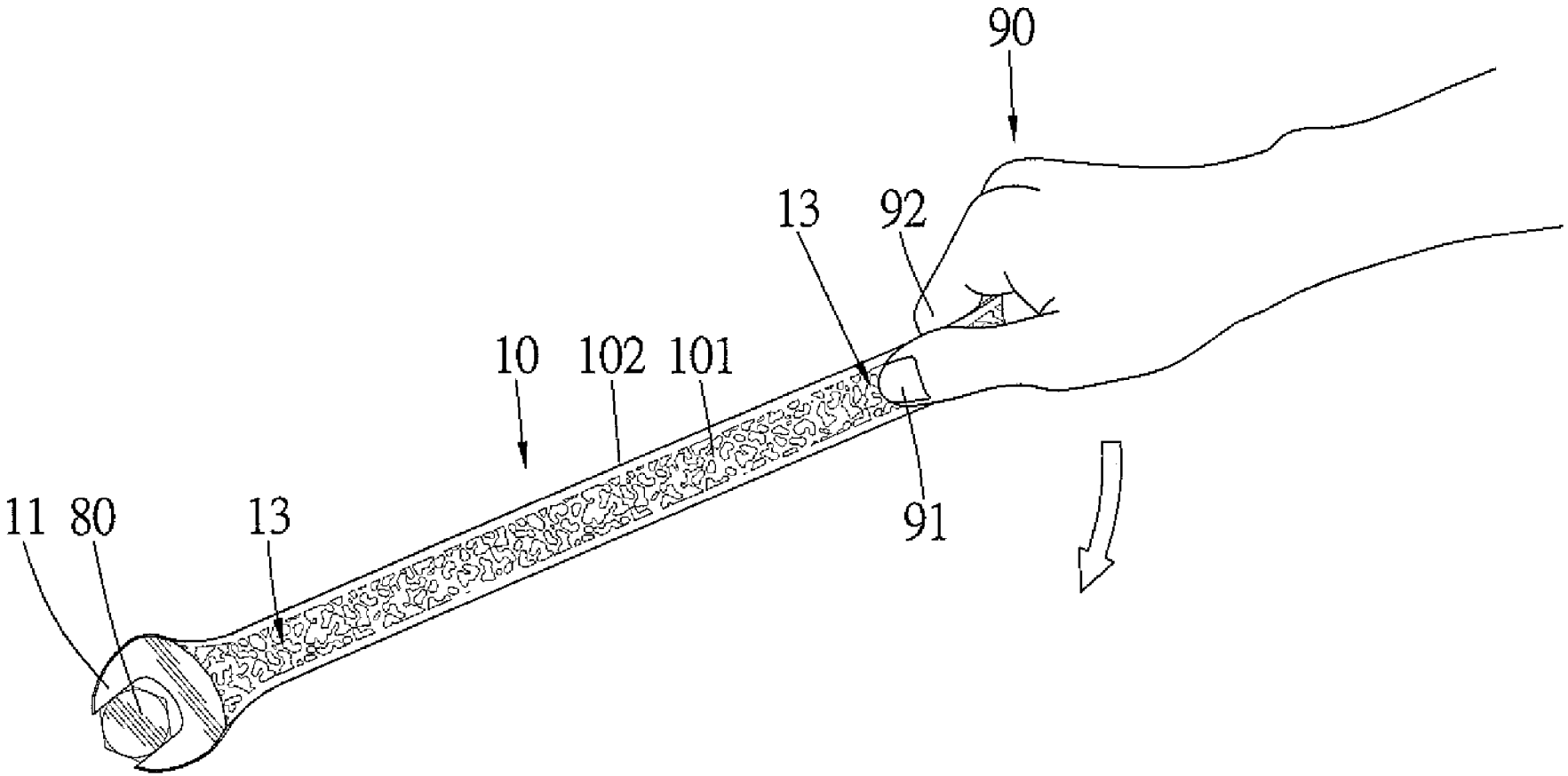
FIG. 8 is a top view illustrating final tightening of a fastener with the wrench in FIG. 7.

FIGS. 7 and 8 illustrate use of the other end of the wrench, wherein the wrench is operated with the other end 11 in the form of an open end. The same anti-slipping effect is obtained during operation of the wrench by providing the anti-slipping sections 13.

Figure 9:
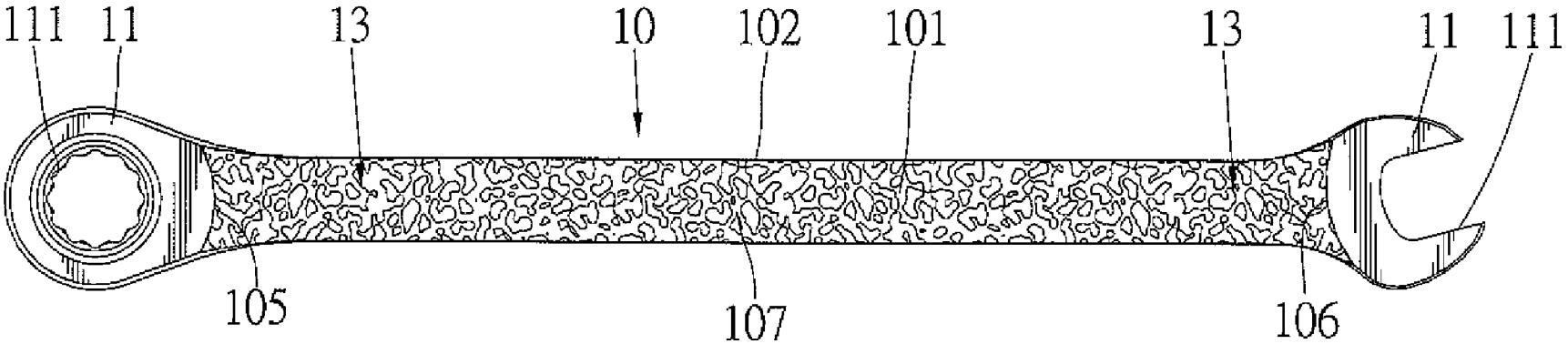
FIG. 9 is a top view of a second embodiment of the wrench in accordance with the present invention.
Figure 10:
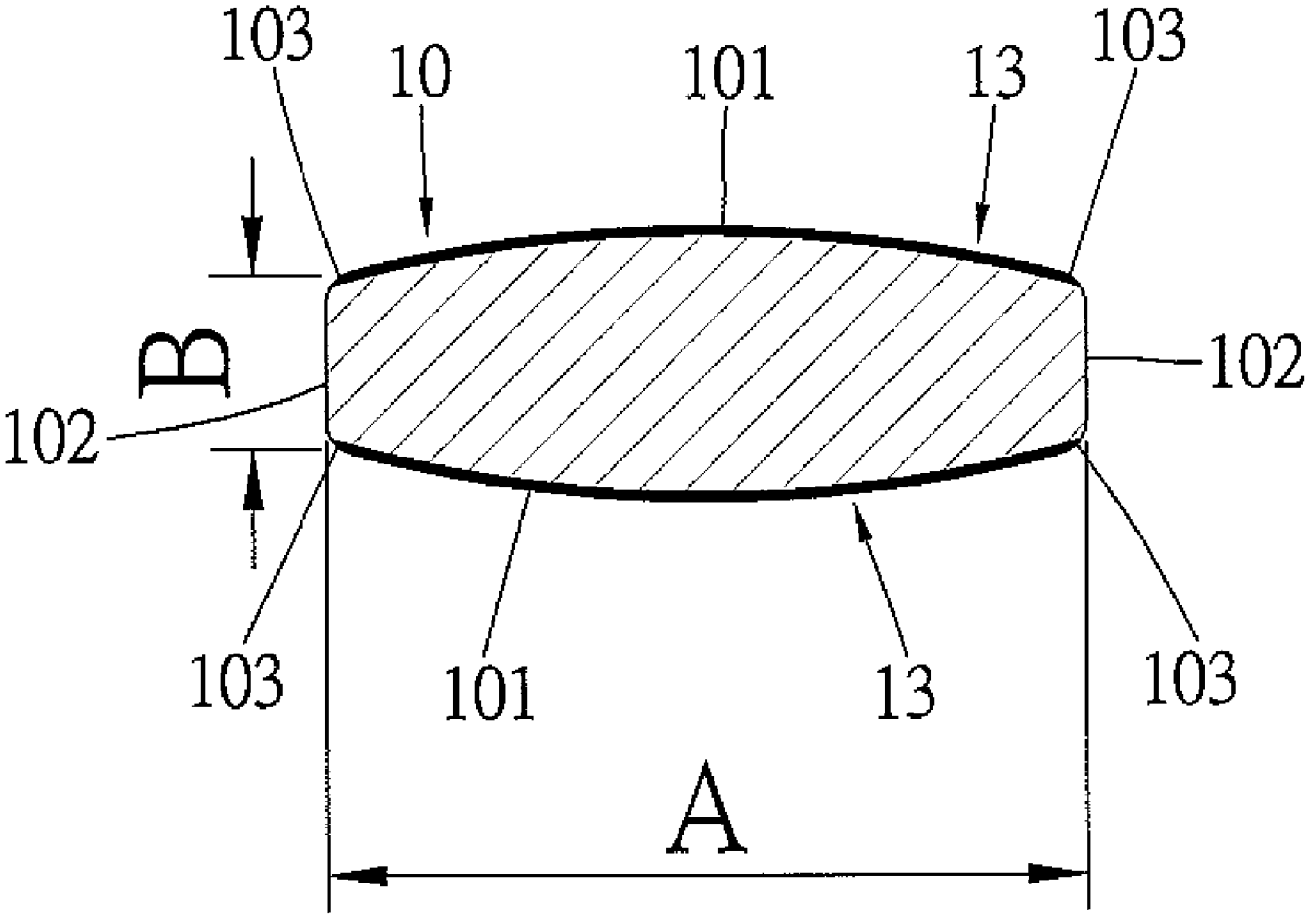
FIG. 10 is a sectional view of a handle of the wrench in FIG. 9.
Figure 11:
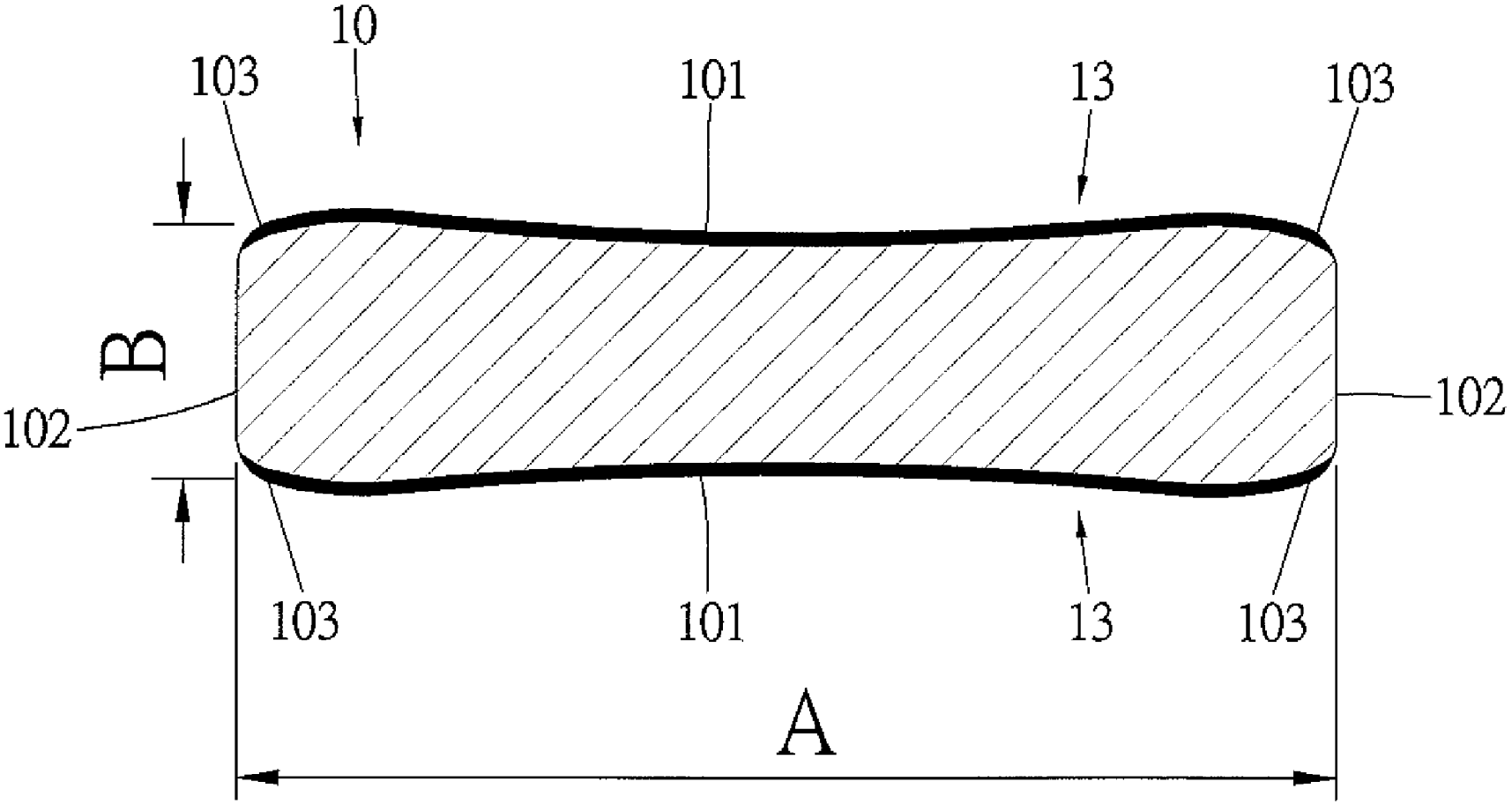
FIG. 11 is a sectional view of an alternate handle of the wrench in FIG. 9.

FIG. 9 illustrates a second embodiment of the wrench in accordance with the present invention. In this embodiment, each anti-slipping section 13 extends transversely to the jointing areas 103 between the respective holding faces 101 and the respective lateral faces 102 regardless whether the holding face 101 is outwardly arcuate or inwardly arcuate, as best seen in FIGS. 10 and 11. A better anti-slipping effect is obtained, as the area of each anti-slipping section 13 is larger.

Figure 12:
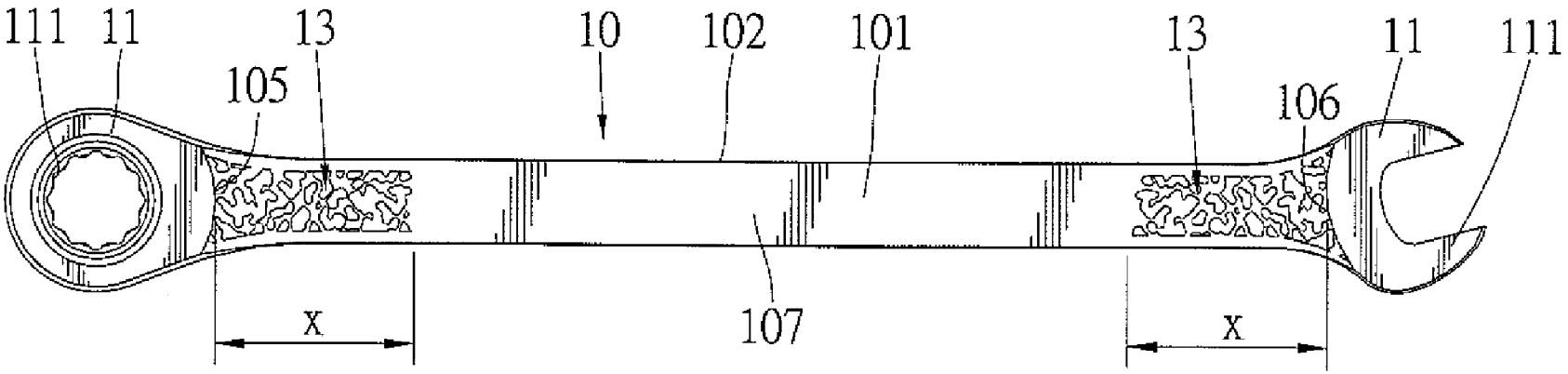
FIG. 12 is a top view of a third embodiment of the wrench in accordance with the present invention.

FIG. 12 illustrates a third embodiment of the wrench in accordance with the present invention. In this embodiment, an anti-slipping section 13 is formed on each end portion of each holding face 101 of the handle 10. Preferably, the anti-slipping section 13 on each end portion extends from an intersection between the associated end 11 and the associated holding face 101 to a length X. The length X of each anti-slipping section 13 is preferably one fourth (¼) of the overall length of the handle 10. Alternatively, the length X is not smaller than an average length of the distal section of the thumb 91 of a user and not greater than two times of the average length of the distal section of the thumb 91 of the user. The blank area between the anti-slipping sections 13 on the same holding face 101 of the handle 10 may include figures, trademark(s), trade name(s), sizes of the wrench, marks, other patterns, etc.

Figure 13:
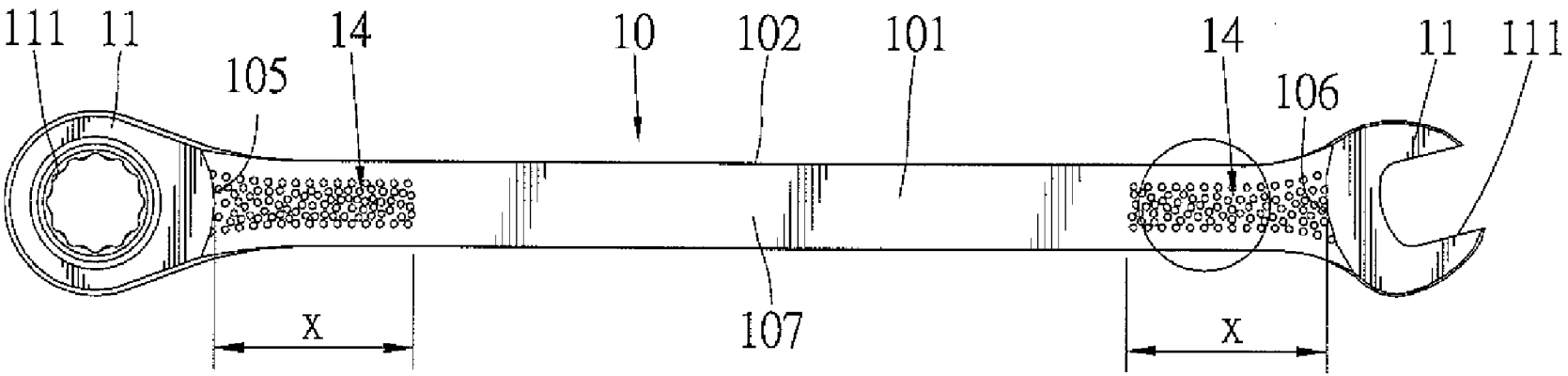
FIG. 13 is a top view of a fourth embodiment of the wrench in accordance with the present invention.
Figure 13A:
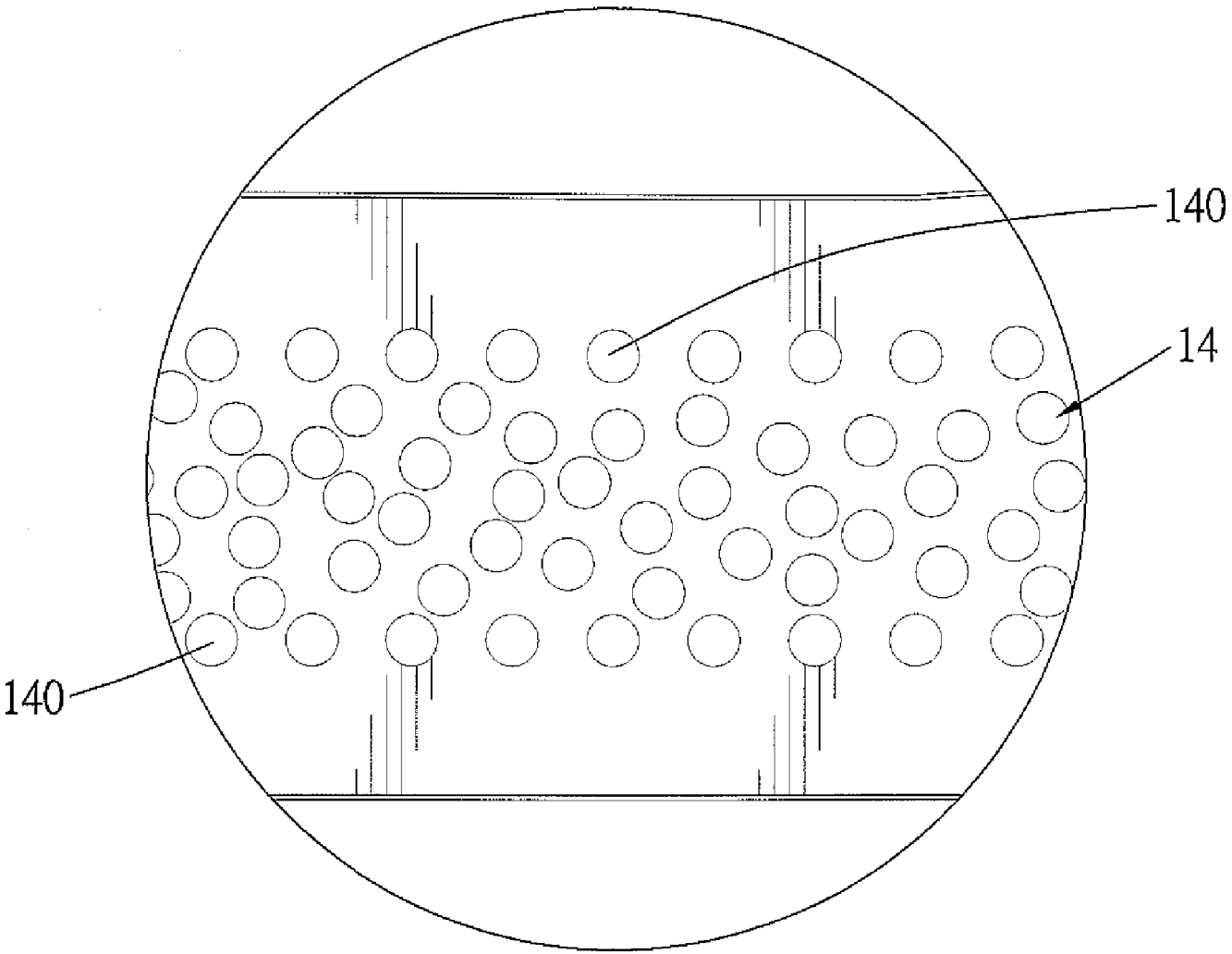
FIG. 13A is an enlarged view of a circled portion in FIG. 13.

FIGS. 13 and 13A illustrate a fourth embodiment of the wrench in accordance with the present invention modified from the third embodiment. In this embodiment, each anti-slipping section 14 includes a plurality of embossed patterns 140 that have regular shapes and that are irregularly distributed, providing the required anti-slipping effect.

Figure 14:
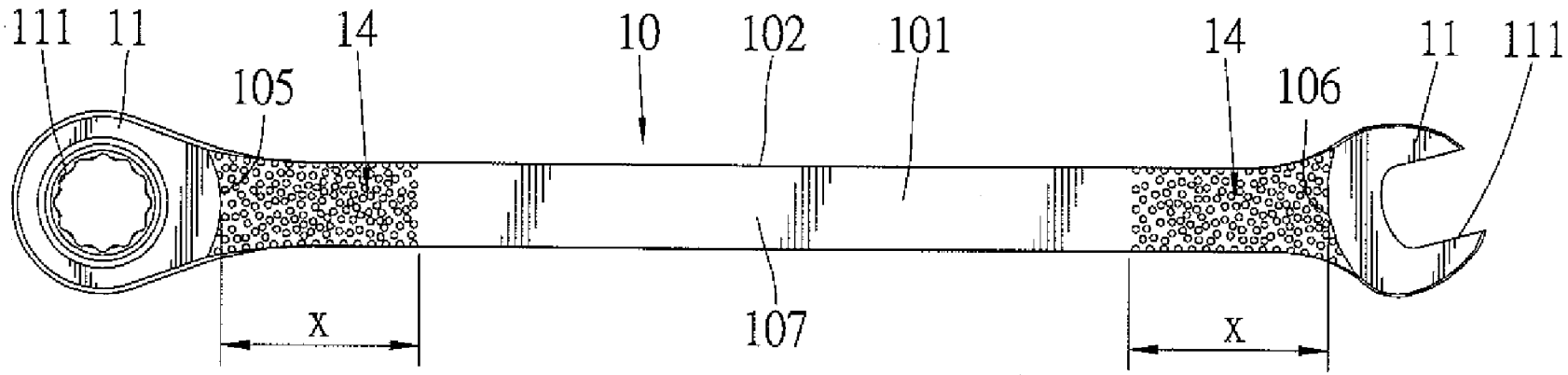
FIG. 14 is a top view of a fifth embodiment of the wrench in accordance with the present invention.

FIG. 14 illustrates a fifth embodiment of the wrench in accordance with the present invention modified from the fourth embodiment. In this embodiment, each anti-slipping section 14 extends transversely to the jointing areas 103 between the respective holding faces 101 and the respective lateral faces 102.

Figure 15:
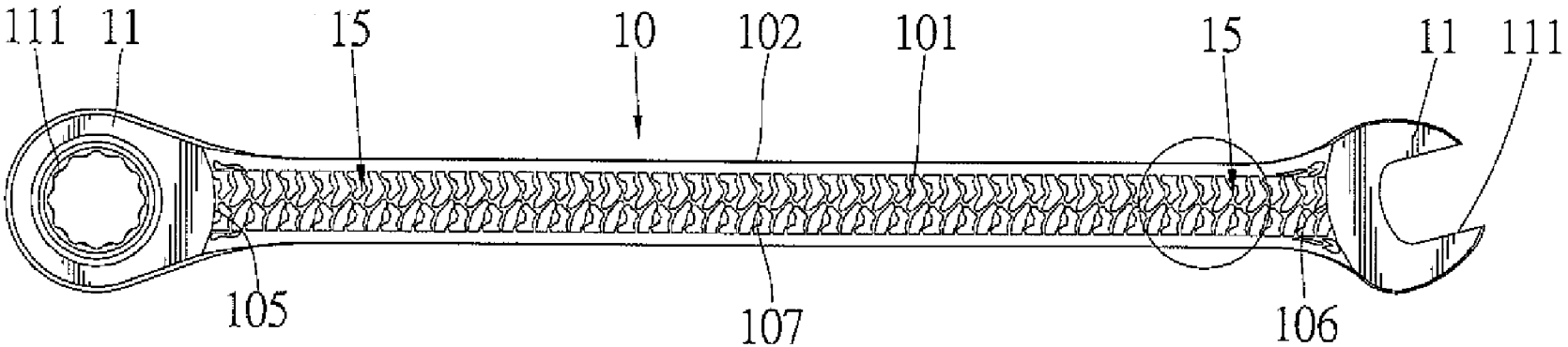
FIG. 15 is a top of a sixth embodiment of the wrench in accordance with the present invention.
Figure 15A:
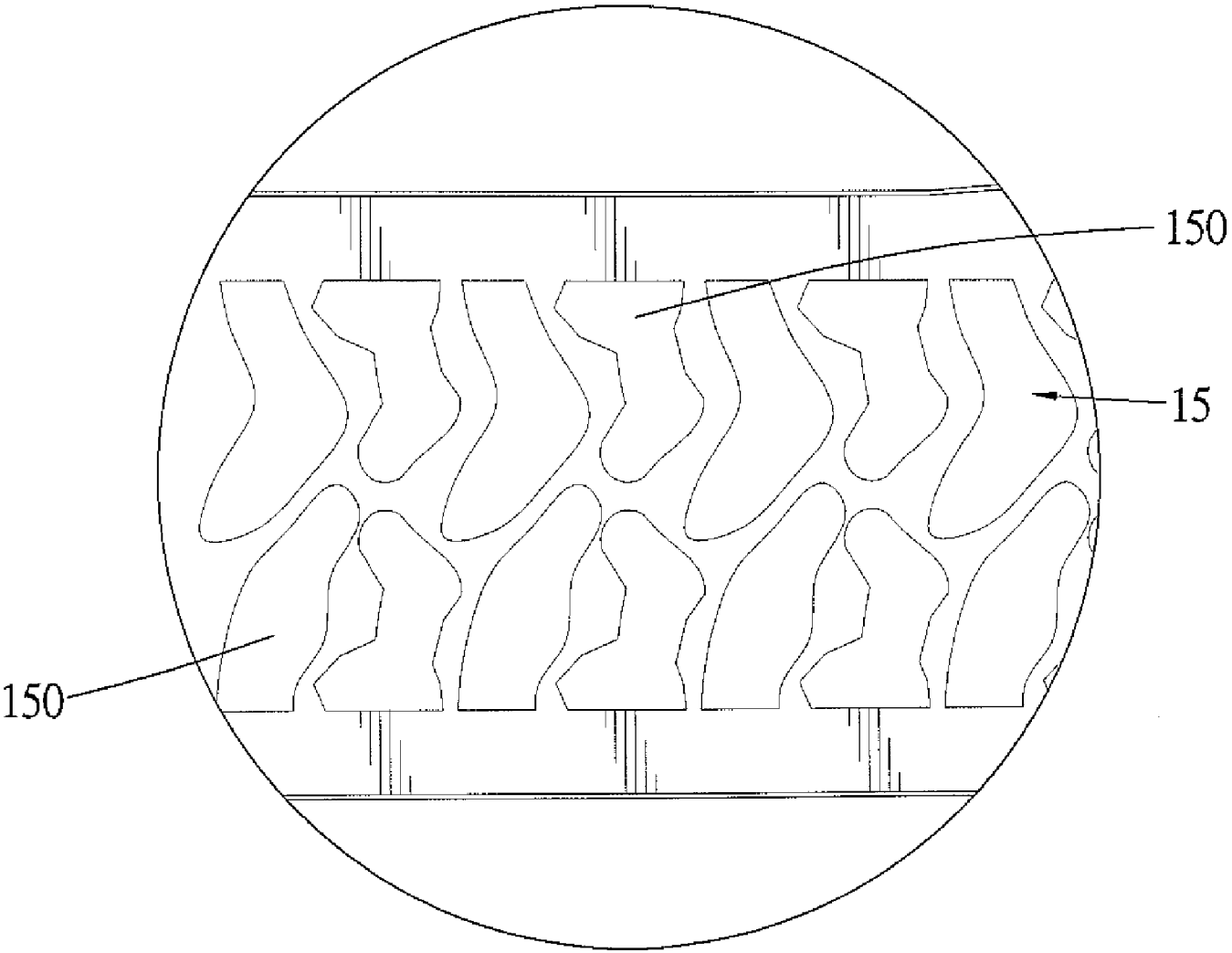
FIG. 15A is an enlarged view of a circled portion in FIG. 15.

FIGS. 15 and 15A illustrate a sixth embodiment of the wrench in accordance with the present invention modified from the first embodiment. In this embodiment, each anti-slipping section 15 includes a plurality of embossed patterns 150 that have irregular shapes and that are regularly distributed, providing the required anti-slipping effect.

Figure 16:
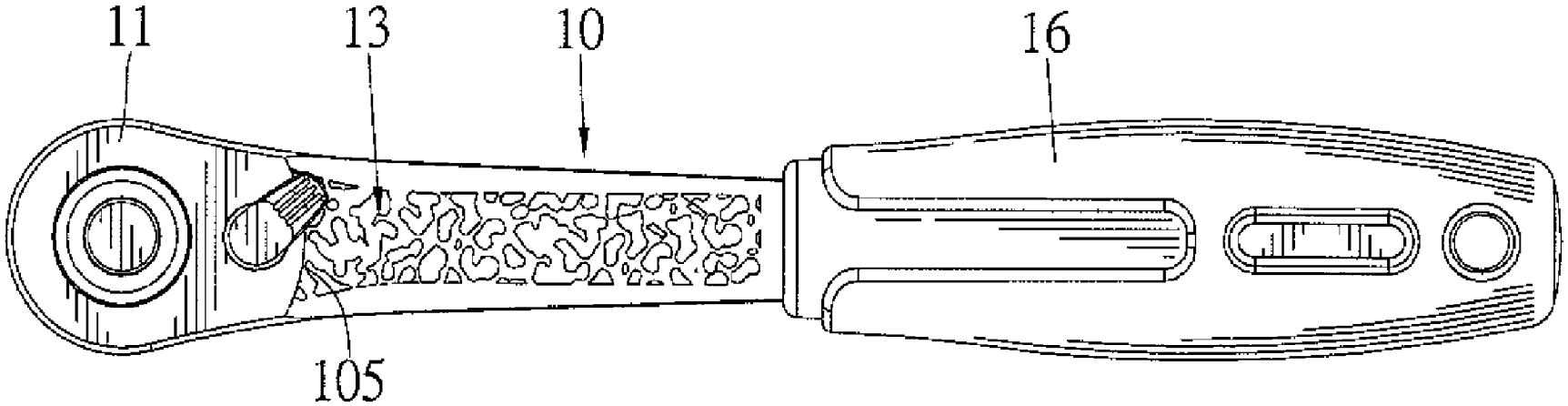
FIG. 16 is a top view of a seventh embodiment of the wrench in accordance with the present invention.
Figure 17:
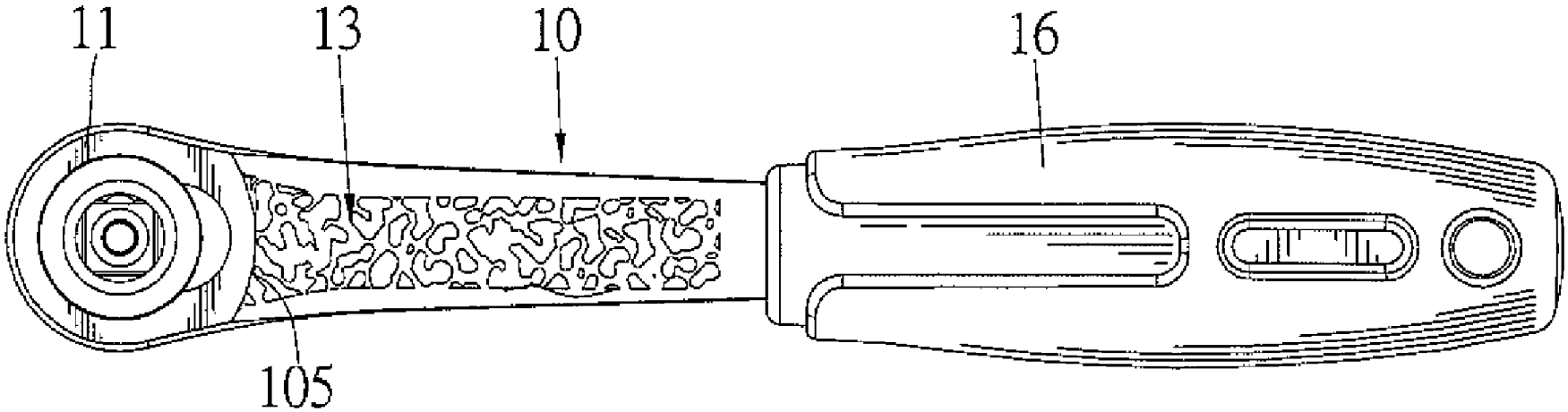
FIG. 17 is a bottom view of the wrench in FIG. 16.

FIGS. 16 and 17 illustrate a seventh embodiment of the wrench in accordance with the present invention. In this embodiment, a sleeve or jacket 16 is mounted to an end of the handle 10 and the other end 11 of the handle is capable of coupling with a fastener 80, a socket, an adaptor, etc.

The directionless anti-slipping sections 13, 14, and 15 on the wrench in accordance with the present invention provide a reliable anti-slipping effect and stable holding of the wrench for rapid back-and-forth fastening operation as well as for large-torque operation. Further, the embossed patterns 130, 140, and 150 are directly formed on the handle 10 so as to enjoy the benefit of reduced finishing costs but without adversely affecting the strength of the handle 10, avoiding damage to the handle and maintaining the required anti-slipping function. No additional anti-slipping device is required and the manufacturing cost is low. Further, the anti-slipping sections 13, 14, and 15 are formed on the upper and lower faces (i.e., the holding faces 101) of the wrench, providing a reliable anti-slipping effect.

Although specific embodiments have been illustrated and described, numerous modifications and variations are still possible without departing from the essence of the invention. The scope of the invention is limited by the accompanying claims.

What is claimed is:

1. A wrench comprising a body including a first end adapted for driving an object, and a handle, wherein the handle comprises an upper face, a lower face opposite to the upper face, and two lateral faces between the upper face and the lower face of the handle and wherein each said lateral face has a width between the upper and lower faces smaller than a spacing of the upper and lower faces between the two lateral faces, with the handle including a first end portion interconnected to the first end, with the width of each said lateral face of the first end portion and of the handle being less than a thickness of the first end parallel to the width, with an anti-slipping section being directly formed on the first end portion of each of the upper face and the lower face of the handle up to but not including the first end, with the first end being free of the anti-slipping section, each said anti-slipping section including a depth and a plurality of embossed patterns, wherein the two lateral faces are free of the anti-slipping section, and wherein each said anti-slipping section is spaced from a joint area between each said lateral face and one of the upper face and the lower face, wherein the upper face and the lower face are outwardly arcuate.

2. The wrench as claimed in claim 1 wherein the embossed patterns have regular shapes and are irregularly distributed.

3. The wrench as claimed in claim 2 wherein the embossed patterns are of circular cross sections parallel to the upper and lower faces.

4. The wrench as claimed in claim 1 wherein the embossed patterns have irregular shapes and are regularly distributed.

5. The wrench as claimed in claim 1 wherein the embossed patterns have irregular shapes and are irregularly distributed.

6. The wrench as claimed in claim 1 wherein each said anti-slipping section has a length substantially equal to one fourth of an overall length of the handle.

7. The wrench as claimed in claim 1 wherein the length of each said anti-slipping section is not smaller than an average length of the distal section of a thumb of a user and not greater than two times of the average length of the distal section of the thumb of the user.

8. The wrench as claimed in claim 1 wherein the body includes a second end adapted for driving the object, with the handle including a second end portion interconnected to the second end, with the width of each said lateral face of the second end portion and of the handle being less than a thickness of the second end parallel to the width, with the anti-slipping section being formed on the second end portion of each of the upper and lower faces of the handle up to but not including the second end, with the second end being free of the anti-slipping section.

9. The wrench as claimed in claim 8 wherein the anti-slipping sections on each of the upper face and the lower face of the handle further extend across an intermediate section of the handle between the end portions of the handle.

10. The wrench as claimed in claim 9 wherein the embossed patterns have regular shapes and are irregularly distributed.

11. The wrench as claimed in claim 9 wherein the embossed patterns have irregular shapes and are regularly distributed.

12. The wrench as claimed in claim 9 wherein the embossed patterns have irregular shapes and are irregularly distributed.

13. A wrench comprising a body including a first end adapted for driving an object, and a handle, wherein the handle comprises an upper face, a lower face opposite to the upper face, and two lateral faces between the upper face and the lower face of the handle and wherein each said lateral face has a width between the upper and lower faces smaller than a spacing of the upper and lower faces between the two lateral faces, with the handle including a first end portion interconnected to the first end, with the width of each said lateral face of the first end portion and of the handle being less than a thickness of the first end parallel to the width, with an anti-slipping section being directly formed on the first end portion of each of the upper face and the lower face of the handle up to but not including the first end, with the first end being free of the anti-slipping section, each said anti-slipping section including a depth and a plurality of embossed patterns, wherein the two lateral faces are free of the anti-slipping section, and wherein each said anti-slipping section is spaced from a joint area between each said lateral face and one of the upper face and the lower face, wherein the upper face and the lower face are inwardly arcuate.

14. The wrench as claimed in claim 13 wherein the embossed patterns have regular shapes and are irregularly distributed.

15. The wrench as claimed in claim 14 wherein the embossed patterns are of circular cross sections parallel to the upper and lower faces.

16. The wrench as claimed in claim 13 wherein the embossed patterns have irregular shapes and are regularly distributed.

17. The wrench as claimed in claim 13 wherein the embossed patterns have irregular shapes and are irregularly distributed.

18. The wrench as claimed in claim 13 wherein each said anti-slipping section has a length substantially equal to one fourth of an overall length of the handle.

19. The wrench as claimed in claim 13 wherein the length of each said anti-slipping section is not smaller than an average length of the distal section of a thumb of a user and not greater than two times of the average length of the distal section of the thumb of the user.

20. The wrench as claimed in claim 13 wherein the body includes a second end adapted for driving the object, with the handle including a second end portion interconnected to the second end, with the width of each said lateral face of the second end portion and of the handle being less than a thickness of the second end parallel to the width, with the anti-slipping section being formed on the second end portion of each of the upper and lower faces of the handle up to but not including the second end, with the second end being free of the anti-slipping section.

21. The wrench as claimed in claim 13 wherein the anti-slipping sections on each of the upper face and the lower face of the handle further extend across an intermediate section of the handle between the end portions of the handle.

22. The wrench as claimed in claim 21 wherein the embossed patterns have regular shapes and are irregularly distributed.

23. The wrench as claimed in claim 21 wherein the embossed patterns have irregular shapes and are regularly distributed.

24. The wrench as claimed in claim 21 wherein the embossed patterns have irregular shapes and are irregularly distributed.

* * * * *